United States Patent [19]

Williamson

[11] Patent Number: 5,016,779

[45] Date of Patent: May 21, 1991

[54] APPARATUS FOR DISPENSING MEASURED AMOUNTS OF FLUID FROM AN OPEN-ENDED POUCH

[76] Inventor: Nic Williamson, 3447 No. 1 Sideroad, Burlington, Ontario, Canada, L7R 3Y4

[21] Appl. No.: 477,421

[22] Filed: Feb. 9, 1990

[51] Int. Cl.[5] ..... B65D 35/28

[52] U.S. Cl. ..... 222/95; 222/105; 222/181; 222/447

[58] Field of Search ..... 222/92, 94, 95–96, 222/105, 207, 214, 181, 185, 448, 450–451, 496, 445, 447

[56] References Cited

U.S. PATENT DOCUMENTS

| | | | |
|---|---|---|---|
| 4,042,153 | 8/1977 | Callahan et al. | 222/207 |
| 4,463,876 | 8/1984 | Swallert | 222/94 |
| 4,564,127 | 1/1986 | Garabedian et al. | 222/96 |
| 4,932,562 | 6/1990 | Christine | 222/214 X |

FOREIGN PATENT DOCUMENTS

| | | | |
|---|---|---|---|
| 329532 | 8/1989 | European Pat. Off. | 222/105 |
| 360773 | 1/1960 | Switzerland | 222/214 |

*Primary Examiner*—Michael S. Huppert
*Assistant Examiner*—Gregory L. Huson
*Attorney, Agent, or Firm*—Smart & Biggar

[57] ABSTRACT

The specification describes a dispenser mechanism for use with fluid filled pouches. The mechanism includes a pair of upper jaws and a pair of lower jaws in order to pinch the spout of the fluid filled pouch. Each of these pairs of jaws, in turn, has a fixed jaw and a movable jaw, each of which are aligned on opposite sides of the spout. A hammer mechanism is integrally mounted to the mechanism, between the pairs of jaws, and operates to expel the fluid from the spout.

1 Claim, 2 Drawing Sheets

APPARATUS FOR DISPENSING MEASURED AMOUNTS OF FLUID FROM AN OPEN-ENDED POUCH

FIELD OF THE INVENTION

This invention relates to a fluid dispenser for dispensing a predetermined volume of fluid from a large container of fluid. More particularly, the present invention relates to a dispenser for dispensing fluids, such as liquid soap from a flexible, collapsible bag.

BACKGROUND OF THE INVENTION

Fluid dispensers are well known for use within institutional environments that require the sanitary and hygienic dispensation of substances such as soaps and shampoos. One known type of fluid dispenser is wall-mountable, and utilizes an internal bag or tube that is filled with fluid, such as liquid soap. The bag is flexible and disposable. Further, the bag has two chambers, namely, a main upper reservoir compartment and a lower dispensing bulb that is capable of holding a measured amount of fluid. A dispensing spout extends downwardly from the bulb, and hangs externally from the dispenser.

Various fluid dispensers have been proposed for use with such bags, utilizing both gravitational and mechanical forces. Such dispensers, however, typically have two major problems, namely the ability to effectively seal the opening between the main reservoir and the dispensing bulb, and the requirement of a relatively complex mechanical device to expel the fluid from the bag.

An attempt has been made to remedy these problems. U.S. Pat. No. 4,463,876 relates to a fluid dispensing device in which upper and lower pinching mechanisms are provided for pinching the discharge portion of the bag, below the main reservoir. The upper pinching mechanism includes a fixed jaw and a movable jaw, while the lower pinching mechanism includes two jaws which are each movable with respect to the stationary housing and with respect to one another. As a result, it is necessary to provide stops on the stationary housing which serves to limit the movement of one of the lower jaws while permitting continued movement of the other jaw. This arrangement therefore requires a complex mechanism which does not ensure a tight or effective seal between the movable lower jaws.

SUMMARY OF THE INVENTION

An object of the present invention is to provide a fluid dispenser for use with a disposable, compressible bag having means to effectively expel fluids of varying viscosities.

A further object of the present invention is to provide a fluid dispenser with means for discharging fluid from the bag that is relatively simple in construction and which can effectively seal the discharge portion of the bag.

According to one broad aspect of the present invention, there is provided a fluid dispenser of the type which is used to dispense a fluid such as soap from a container, of the type having a flexible discharge tube through which fluid may be discharged along a fluid dispensing path that extends through a dispenser station. The dispenser has an upper and lower tube pinching means each having a fixed jaw and a movable jaw located opposite one another and arranged one on a first side and one on a second side of the fluid dispensing path. The movable jaws are mounted for movement along a second path which intersects said fluid dispensing path so as to be movable toward their associated fixed jaw to a closed position in which they cooperate therewith to pinch the discharge tube and thereby prevent the discharge of fluid from the discharge tube and for movement away from their associated fixed jaw to an open position in which they permit the discharge tube to open to allow the discharge of fluid therefrom. The upper and lower movable jaws are arranged one on said first side of said discharge path and one on said second side of the said discharge path and are interconnected by actuator means which is mounted in said dispenser station for movement to and fro along said second path from a first position, in which the upper jaw is in its open position and the lower jaw is in its closed position, to a second position, in which the upper jaw is in its closed position and the lower jaw is in its open position. Further, tube compression means are carried by said actuator means and are located in a first position in which it will not compress said tube when the actuator means are located in its first position and serves to compress said tube, and it is carried by actuator means into compressive contact with said tube, to expel fluid therefrom as the actuator means moves from its first position to its second position, said tube compression means being carried by said actuator means out of compressive contact with said tube to permit said fluid to enter said tube as said actuator means moves from its second position to its first position.

BRIEF DESCRIPTION OF DRAWINGS

With reference to the accompanying drawings, by way of example and not limitation, an example embodiment of the invention is shown in which.

DESCRIPTION OF PREFERRED EMBODIMENTS

Figure 1:
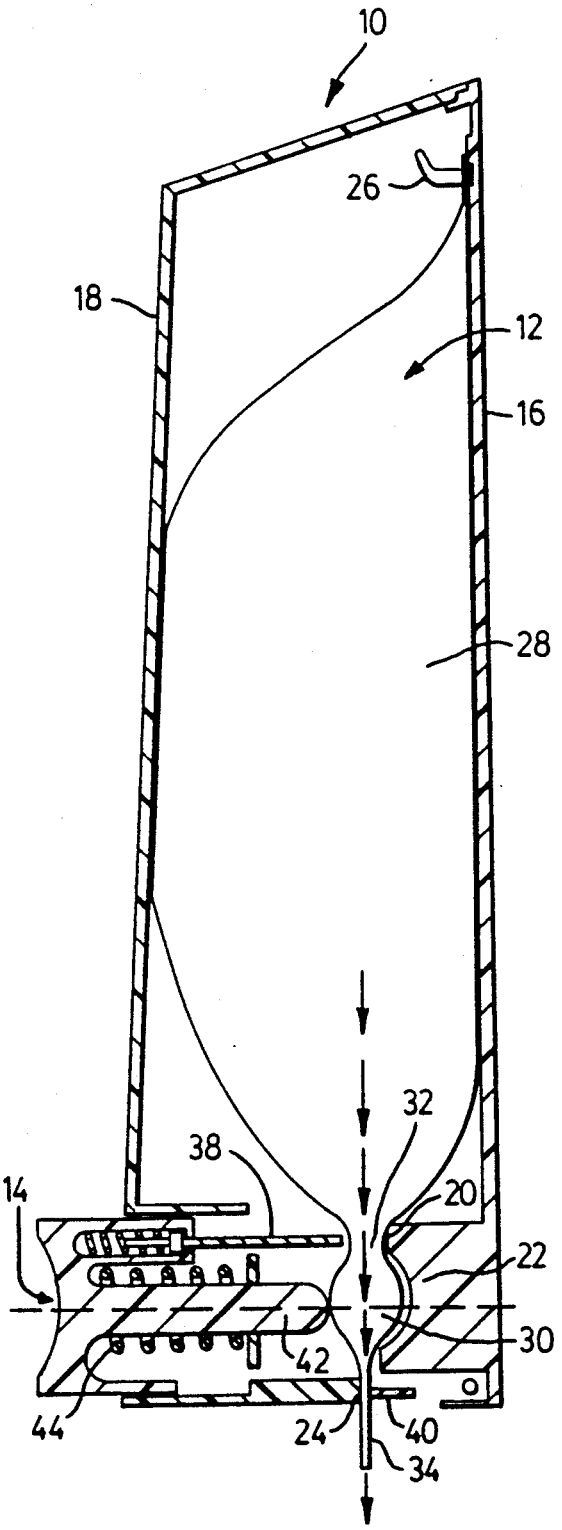
FIG. 1 is a side view, in partial section, showing the fluid dispenser of the present invention.
Figure 2:
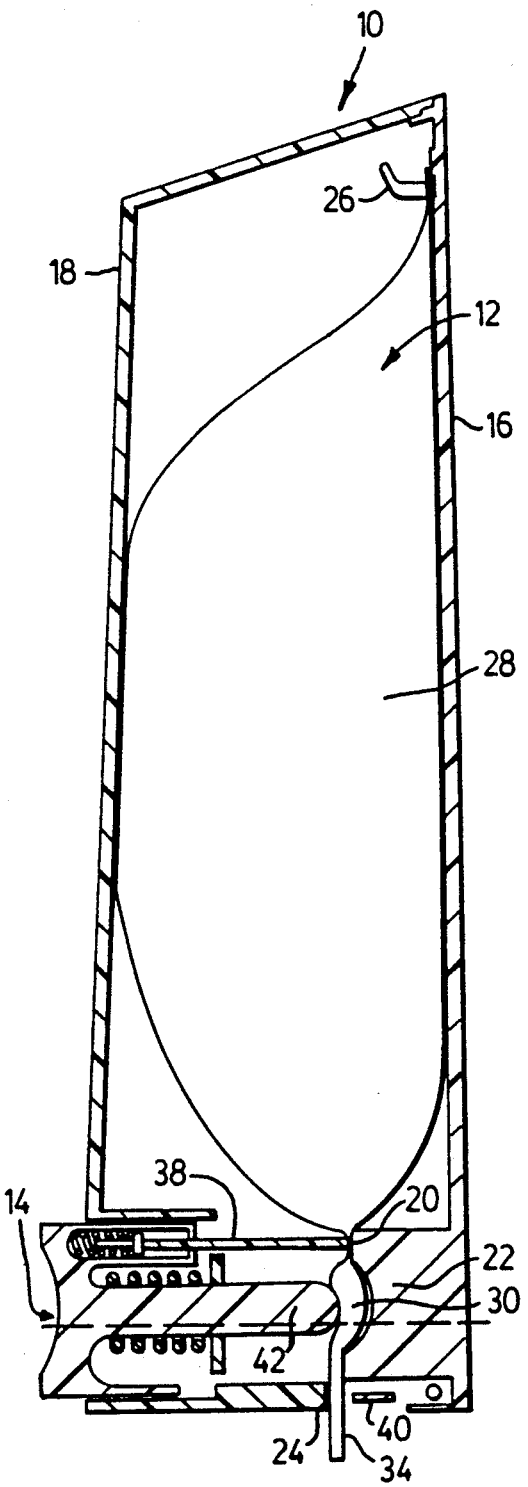
FIG. 2 is a side view, in partial section, showing the fluid dispenser of FIG. 1 in operation.
Figure 4:
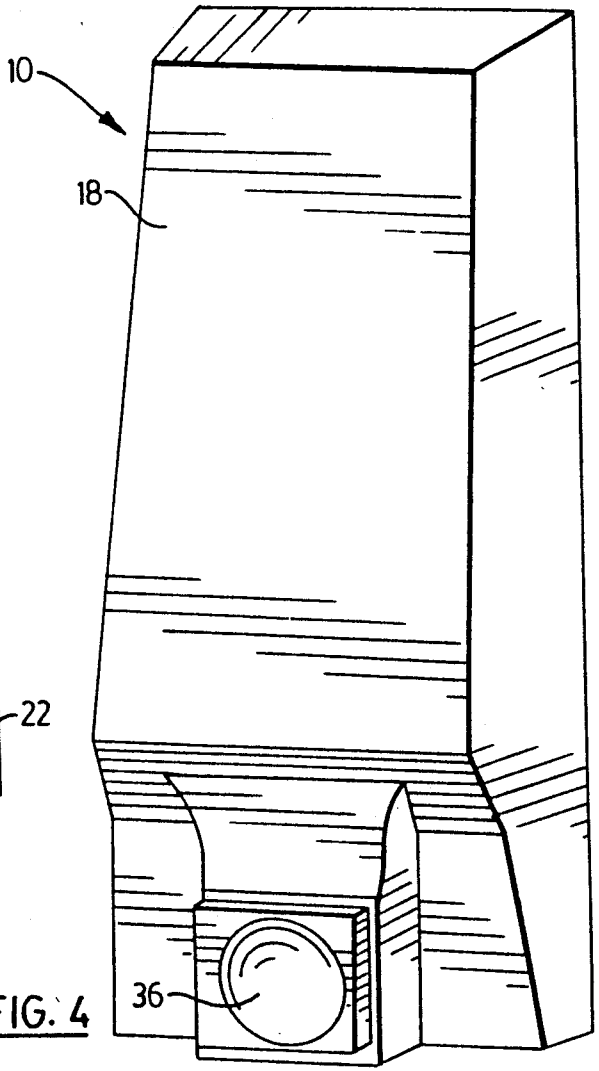
Figure 3:
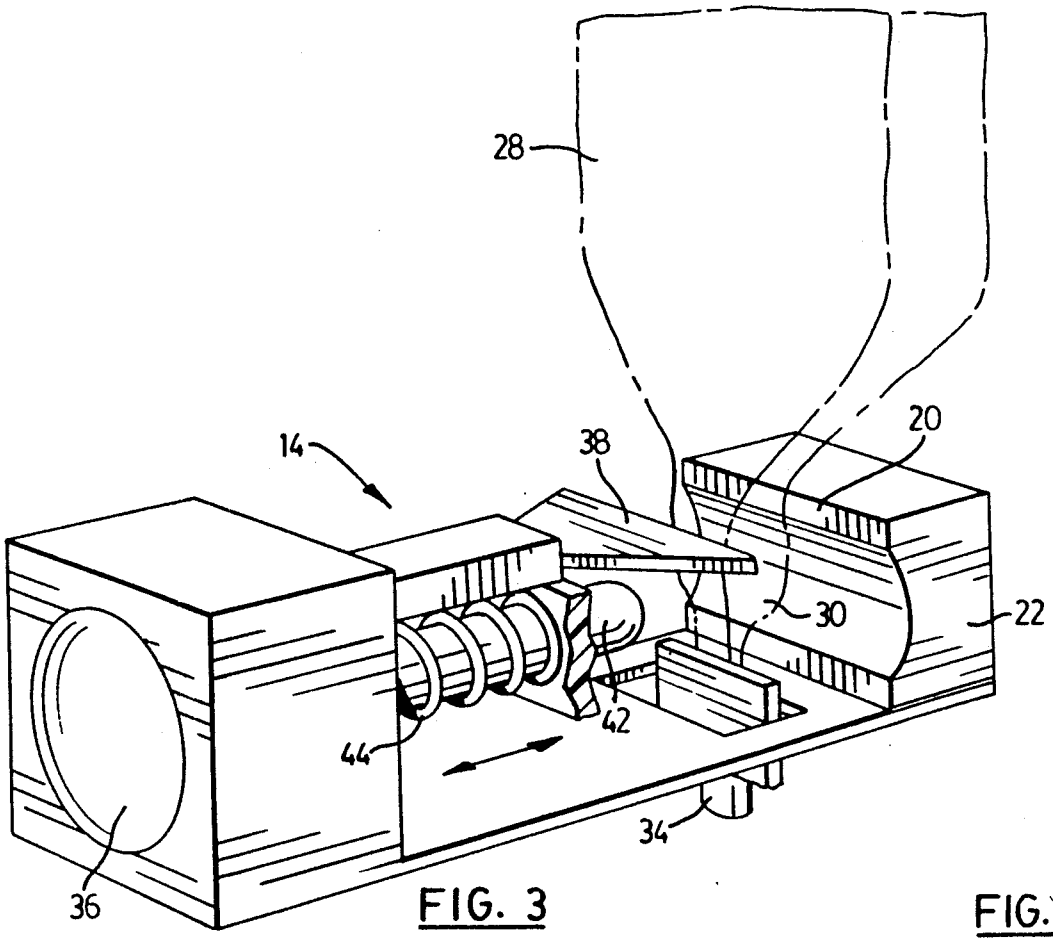
FIG. 3 is a perspective view, in partial section, of the pumping mechanism of the fluid dispenser; and, FIG. 4 is a perspective view of the fluid dispenser.

With reference to the drawings, the device of the present invention generally comprises a frame 10, a flexible discharge bag or tube 12 that is mounted within said frame 10 and extends downwardly therefrom, and a dispensing station or mechanism 14 that is resiliently mounted within said frame 10.

Frame 10 comprises a backplate 16 which is adapted to be mounted to a wall, a cover 18 is pivotally connected to the top of said backplate 16, and a bottom base (not shown). An upper fixed jaw 20 is mounted to said backplate 16. A concave-shaped anvil 22 is integrally connected to said upper fixed jaw 20. A lower fixed jaw 24 is mounted to said bottom base, and is positioned forwardly of said upper fixed jaw 20. A mounting hook 26 is located towards the top of backplate 16.

Flexible discharge tube 12 comprises a main, upper reservoir 28 and a lower bulb 30 that is generally spherical in shape. A tubular passage 32 connects reservoir 28 to bulb 30, and spout 34 extends downwardly from said bulb. Discharge tube 12 is adapted to be mounted within frame 10 by attachment at its upper end to mounting hook 26.

When flexible discharge tube 12 is mounted within frame 10, dispensing bulb 30 is aligned horizontally with, and forwardly of, concave-shaped anvil 22 while tubular passage 32 is aligned horizontally with, and forwardly of, upper fixed jaw 20. Spout 34 is aligned horizontally with, and rearwardly of, lower fixed jaw 24.

Dispensing station 14 includes a push button actuator means 36 that extends externally from said frame 10. Integrally mounted to said actuator means, and located internally of said frame, are an upper movable jaw 38 and a lower movable jaw 40. Lower movable jaw 40 is positioned rearwardly of said upper movable jaw 38. Positioned between said movable jaws 38 and 40, and also mounted to said actuator means is a movable hammer 42 having a convex-shaped face. A spring 44 is positioned around said hammer, thereby resiliently mounting said dispensing station 14 within the frame.

When mounted for use, spring 44 urges the integrally mounted upper movable jaw 38, lower movable jaw 40 and hammer 42 to their static positions. In this first position, spout 34 is pinched between fixed lower jaw 24 and the retracted movable lower jaw 40, as these lower pinching mechanisms are in their closed positions. Fluid is thereby prevented from being discharged from bulb 30, as spout 34 is pinched by these lower pinching mechanisms. Fluid from the main reservoir 28 is permitted to flow downwardly through tubular passage 32 and into dispensing bulb 30, however, as the upper movable jaw 38 is in its open position, retracted away from compressive contact with said tubular passage 34.

When it is desired to expel or discharge fluid from tube 12, the user exerts pressure upon actuator means 36. This pressure causes the integrally mounted upper movable jaw 38, lower movable jaw 40 and hammer 42 to move inwardly, in unison. As a result, tubular passage 32 is pinched between movable upper jaw 38 and fixed upper jaw 20 and movable upper jaw 38 which is in its closed position. This creates an effective seal between reservoir 28 and dispensing bulb 30, so that fluid is prevented from flowing downwardly into the discharge path. In this second position, hammer 42 is moved into compressive contact with dispensing bulb 30, as the hammer 42 is urged towards anvil 22, while lower movable jaw 40 moves apart from lower fixed jaw 24. As a result, spout 34 is opened to permit fluid to be expelled from dispensing bulb 30, and through spout 34.

Once the fluid from the dispensing bulb 30 has been discharged, the user releases pressure from the push button actuator means 36. The spring mounted actuator means thereby return the upper movable jaw 38, lower movable jaw 40 and hammer 42 to their original static positions, thus closing the lower pinching mechanisms while opening the upper pinching mechanisms.

It will be appreciated that by providing an upper pair of movable and fixed jaws and a lower pair of movable and fixed jaws, each of which act upon opposed sides of said disposable tube 12, a simple mechanical mechanism can be employed for effectively dispensing fluid from the tube and for sealing the discharge tube from any undesired leakage.

I claim:

1. In a fluid dispenser of the type which is used to dispense a fluid such as soap from a container, of the type having a flexible discharge tube through which fluid may be discharged along a fluid dispensing path that extends through a dispenser station, the dispenser having:

(i) upper and lower tube pinching means each having a fixed jaw and a movable jaw located opposite one another, and said fixed jaws being arranged one on a first side and one on a second side of the fluid dispensing path, the movable jaws being mounted for movement along a second path which intersects said fluid dispensing path so as to be movable toward their associated fixed jaw to a closed position in which they cooperate therewith to pinch the discharge tube and thereby prevent the discharge of fluid from the discharge tube and for movement away from their associated fixed jaw to an open position in which they permit the discharge tube to open to allow the discharge of fluid therefrom, the upper and lower movable jaws are arranged one on said first side of said dispensing path and are interconnected by an actuator means which is mounted in said dispenser station for movement to and fro along said second path from a first position, in which the upper movable jaw is in its open position and the lower movable jaw is in its closed position, to a second position, in which the upper movable jaw is in its closed position and the lower movable jaw is in its open position; and, (ii) tube compression means carried by said actuator means and located in a first position in which it will not compress said tube when said actuator means is located in its first position and carried by said actuator means into compressive contact with said tube, to expel fluid therefrom as the actuator means moves from its first position to its second position, said tube compression means being carried by said actuator means out of compressive contact with said tube to permit said fluid to enter said tube as said actuator means moves from its second position to its first position.

* * * * *